US012252817B2

(12) United States Patent
Huang et al.

(10) Patent No.: US 12,252,817 B2
(45) Date of Patent: Mar. 18, 2025

(54) AIR DISTURBANCE TYPE CARBON FIBER SPREADING DEVICE

(71) Applicant: ZHENGZHOU UNIVERSITY, Zhengzhou (CN)

(72) Inventors: Ming Huang, Zhengzhou (CN); Jun Zhou, Zhengzhou (CN); Na Zhang, Zhengzhou (CN); Chuntai Liu, Zhengzhou (CN); Yuhu Chen, Zhengzhou (CN); Yang Wang, Zhengzhou (CN); Xianzhang Shi, Zhengzhou (CN); Wei Wei, Zhengzhou (CN)

(73) Assignee: ZHENGZHOU UNIVERSITY, Zhengzhou (CN)

( * ) Notice: Subject to any disclaimer, the term of this patent is extended or adjusted under 35 U.S.C. 154(b) by 0 days.

(21) Appl. No.: 18/260,025

(22) PCT Filed: Sep. 8, 2022

(86) PCT No.: PCT/CN2022/117678
§ 371 (c)(1),
(2) Date: Jun. 29, 2023

(87) PCT Pub. No.: WO2023/116059
PCT Pub. Date: Jun. 29, 2023

(65) Prior Publication Data

US 2024/0060219 A1 Feb. 22, 2024

(30) Foreign Application Priority Data

Dec. 23, 2021 (CN) ..... 202111589981.4

(51) Int. Cl.
*D02J 1/18* (2006.01)

(52) U.S. Cl.
CPC ..... *D02J 1/18* (2013.01); *D10B 2101/12* (2013.01); *D10B 2505/02* (2013.01)

(58) Field of Classification Search
CPC ..... D02J 1/18; D02J 1/00; B65H 2701/314
See application file for complete search history.

(56) References Cited

U.S. PATENT DOCUMENTS 3,417,560 A * 12/1968 Watson ..... D02G 3/06 19/66 T
3,664,115 A * 5/1972 Watson ..... D02J 1/18 57/31

(Continued)

*Primary Examiner* — Jillian K Pierorazio

(57) ABSTRACT

Provided is an airflow disturbance type carbon fiber spreading device. The device includes an unwinding module, an unwinding tension control module, an airflow disturbance spreading module, a winding tension stabilizing module, a deviation correction module and a winding module which are sequentially arranged along a feeding direction. The spreading mechanism includes an airflow disturbance spreading module, the airflow disturbance spreading module includes two airflow disturbance spreading assemblies, each airflow disturbance spreading assembly includes a centrifugal fan, the centrifugal fan communicates with the bottom of an airflow duct, and three spreading guide shafts are arranged side by side on the top of the airflow duct. A tension adjusting assembly is provided between the airflow disturbance spreading assemblies. A seventh spreading guide shaft (13) is located at the upper port of an airflow duct I (25) and is connected to a slider module II (34).

20 Claims, 2 Drawing Sheets

(56) References Cited

U.S. PATENT DOCUMENTS

| | | | | | |
|---|---|---|---|---|---|
| 3,796,035 | A * | 3/1974 | Watson | D02G 1/18 | 57/239 |
| 3,960,645 | A * | 6/1976 | Brackmann | A24D 3/0204 | 493/42 |
| 4,435,239 | A * | 3/1984 | Harris | D01D 11/02 | 28/255 |
| 9,968,492 | B2 * | 5/2018 | Nagata | A61F 13/15723 | |
| 10,570,536 | B1 * | 2/2020 | Faulkner | D02G 3/02 | |
| 2009/0271960 | A1 * | 11/2009 | Kawabe | D02J 1/18 | 28/283 |

* cited by examiner

AIR DISTURBANCE TYPE CARBON FIBER SPREADING DEVICE

CROSS-REFERENCE TO RELATED APPLICATION

This patent application with the PCT Application No. PCT/CN2022/117678 and Application date Sep. 8, 2022, claims the benefit and priority of Chinese Patent Application No. 202111589981.4, filed with the China National Intellectual Property Administration on Dec. 23, 2021, the disclosure of which is incorporated by reference herein in its entirety as part of the present application.

TECHNICAL FIELD

The present disclosure relates to the technical field of carbon fiber composites processing, in particular to an airflow disturbance type carbon fiber spreading device.

BACKGROUND

Thermoplastic carbon fiber composites are widely used in automobile manufacturing, aerospace, sports device and other fields due to their low density, high strength and impact resistance, easy molding and recycling. Carbon fiber reinforced thermoplastic prepreg tapes, as a necessary intermediate for composite molding, have received much attention for its molding and processing. Due to high viscosity and poor fluidity of thermoplastic polymer, it is impossible to pre-impregnate carbon fiber precursors efficiently when preparing carbon fiber reinforced thermoplastic prepreg tape. Therefore, it is necessary to spread the carbon fiber precursors without damage and with high efficiency to widen and thin carbon fiber tows, so as to increase the pre-impregnation efficiency of the thermoplastic polymer.

Carbon fiber spreading technology mainly includes a mechanical method, an ultrasonic method, an airflow method and so on. The mechanical method is simple in structure, but low in efficiency and high in fiber damage rate, while the ultrasonic method is low in fiber damage rate, but complex in structure and high in device cost. In the airflow method, the fibers are dispersed by using the airflow with low damage, high efficiency and relatively simple, thus the airflow method is one of the commonly used spreading methods. However, in the process of airflow spreading, the running track deviation of fibers caused by the winding mode of carbon fiber precursors may lead to non-uniform fiber dispersion, and even lead to fiber twisting in severe cases. The sudden changes of airflow caused by the start-up of the conventional fan is prone to damaging carbon fiber and is not conducive to the stability of fiber spreading process. At the same time, in the common winding process, the tension of the fiber increases with the increase of the winding diameter, which may lead to interlayer entanglement of carbon fiber spread filaments and lead to the unwinding failure of a spread filament reel.

SUMMARY

In view of the shortcomings in the above background, an airflow disturbance type carbon fiber spread device is provided, which is used to solve the technical problems in the prior art, such as non-uniform fiber dispersion caused by unstable position of carbon fibers in the spreading process, unstable spreading and fiber damage caused by sudden changes of airflow, and interlayer entanglement of spread filaments caused by non-uniform winding tension.

To solve the above technical problems, the present disclosure adopts the following technical solution: an airflow disturbance type carbon fiber spread device includes an unwinding mechanism, a spreading mechanism, a winding mechanism, which spread devices are sequentially arranged along a feeding direction. The unwinding mechanism includes an unwinding module. The unwinding module include at least one unwinding assembly. A carbon fiber roll is placed on the unwinding assembly, and an unwinding tension control module is arranged at the discharge end of the unwinding assembly.

The spreading mechanism includes an airflow disturbance spreading module, which is located at the discharge end of the unwinding tension control module.

The winding mechanism includes a winding module, a winding tension stabilization module and a deviation correction module are provided between the winding module and the airflow disturbance spreading module, and the airflow disturbance spreading module and the deviation correction module are respectively located at the feed end and the discharge end of the winding tension stabilization module. The winding module is located at the discharge end of the deviation correction module.

The unwinding assembly includes an unwinding air shaft, the carbon fiber roll is placed on the unwinding air shaft, the tail part of the unwinding air shaft is connected to a magnetic powder brake, the unwinding air shaft is mounted on a mounting seat, and the mounting seat is slidingly arranged on a sliding module I. A first guide shaft is arranged at the discharge end of the unwinding air shaft, and the carbon fiber released from the carbon fiber roll is introduced into an unwinding tension control module through the first guide shaft.

A position sensor in fit with the carbon fiber is arranged at the discharge end of the first guide shaft and connected to the sliding module I.

The unwinding tension control module includes a tension detection roller I, and the tension detection roller I is connected to the magnetic powder brake. One side of the tension detection roller I is provided with a second guide shaft and a third guide shaft, and the other side of the tension detection roller I is provided with a fourth guide shaft and a fifth guide shaft. The second guide shaft, the third guide shaft, the tension detection roller I, the fourth guide shaft and the fifth guide shaft are arranged in a M-shaped structure in a feeding direction and are all in fit with the carbon fiber.

The airflow disturbance spreading module includes two airflow disturbance spreading assemblies, each airflow disturbance spreading assembly includes a centrifugal fan, the centrifugal fan communicates with the bottom of an airflow duct, and three spreading guide shafts are arranged side by side on the top of the airflow duct. A tension adjusting assembly is provided between the two airflow disturbance spreading assemblies. The spreading guide shaft and the tension adjusting assembly are all in fit with the carbon fiber.

The winding tension stabilization module includes a floating roller module, and the floating roller module is slidingly arranged on a linear slide rail. Both sides of the floating roller module are respectively provided with a twelfth guide shaft and a thirteenth guide shaft in fit with the carbon fiber, and the carbon fiber is introduced into the deviation correction module through the thirteenth guide shaft.

The deviation correction module includes a frame type deviation correcting machine, a fourteenth guide shaft is arranged at the discharge end of the frame type deviation correcting machine, and the carbon fiber passes through the frame type deviation correcting machine and is introduced into the winding module through the fourteen guide shaft.

The winding module includes a winding reel, which is mounted on a winding air shaft, and the winding air shaft is connected to a winding servo motor by a coupling.

A tension detection roller II in fit with the carbon fiber is arranged at the feed end of the winding reel, and is electrically connected to the winding servo motor.

Compared with the prior art, non-damage spreading of the carbon fiber is achieved by using the airflow method, airflow is provided by using a frequency-adjustable centrifugal fan so as to form a stable negative pressure at the upper end of an airflow duct, and the surrounding air forms a stable airflow under the action of pressure. Meanwhile, the carbon fiber tows are uniformly dispersed under the action of the spreading guide shafts. The tension of the carbon fiber is small during the spreading, and the carbon fiber is dispersed mainly by the airflow, which can minimize the damage caused in the spreading process of the carbon fiber. The technical problems in the prior art, such as non-uniform fiber dispersion caused by unstable position of the carbon fibers in the spreading process, unstable spreading and fiber damage caused by sudden change of the airflow, and interlayer entanglement of spread filaments caused by non-uniform winding tension are solved, and the advantages of good carbon fiber spreading effect and high spreading efficiency are achieved.

BRIEF DESCRIPTION OF THE DRAWINGS

To describe the technical solutions in the embodiments of the present disclosure or in the prior art more clearly, the following briefly introduces the accompanying drawings required for describing the embodiments. Apparently, the accompanying drawings in the following description show merely some embodiments of the present disclosure, and those of ordinary skill in the art may still derive other drawings from these accompanying drawings without creative efforts.

FIG. 2A-B are comparison diagrams of carbon fiber spread filaments prepared by different methods, in which FIG. 2A is the surface micro-morphology of carbon fiber spread filaments prepared according the present disclosure, and FIG. 2B is the surface micro-morphology of carbon fiber spread filaments prepared by the conventional mechanical method.

Figure 1:
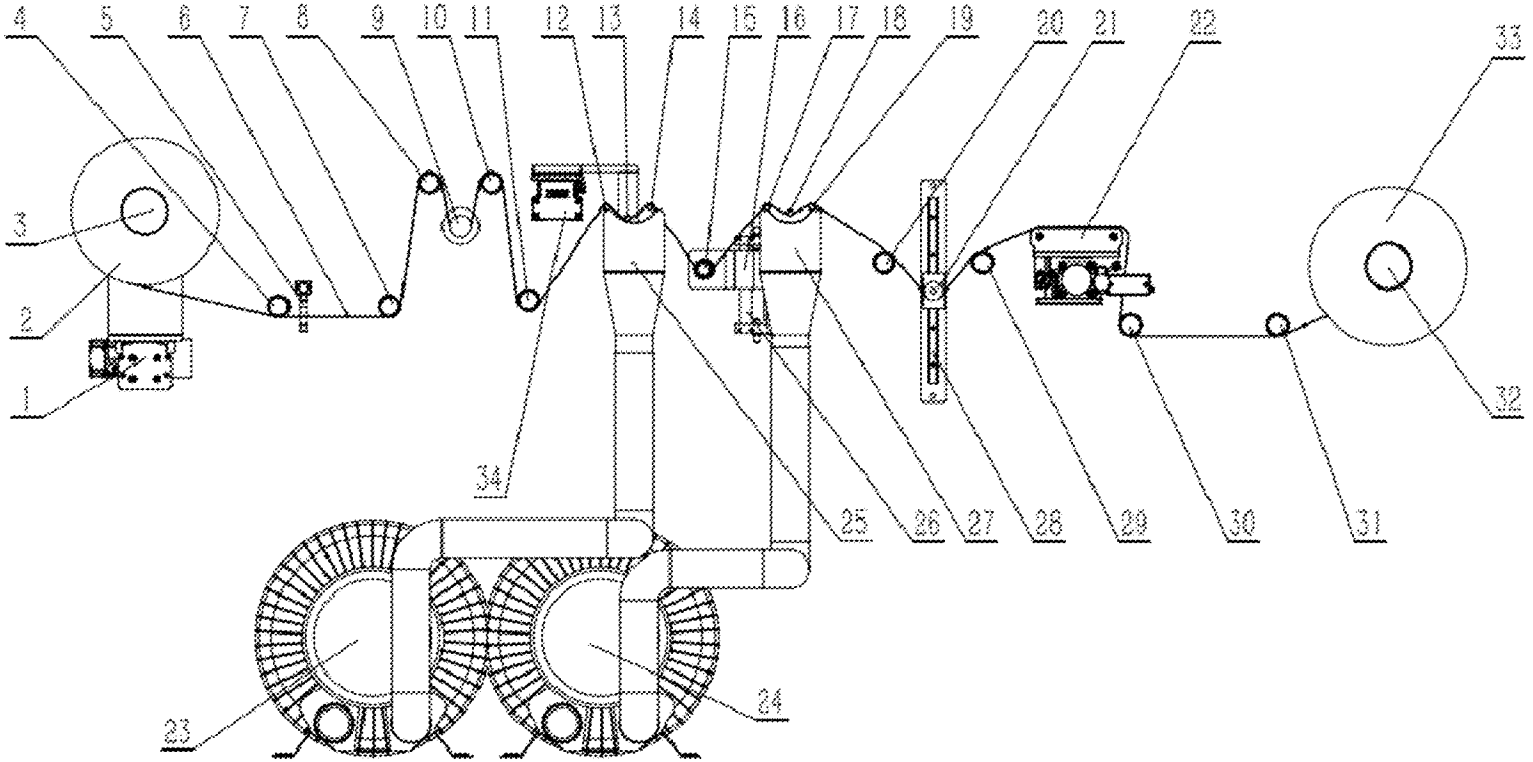
FIG. 1 is a schematic diagram of a structure in accordance with the present disclosure.

In the drawings: 1—sliding module I; 2—carbon fiber roll; 3—unwinding air shaft; 4—first guide shaft; 5—position sensor; 6—carbon fiber; 7—second guide shaft 2; 8—third guide shaft; 9—tension detection roller I; 10—fourth guide shaft; 11—fifth guide shaft; 12—sixth spreading guide shaft; 13—seventh spreading guide shaft; 14—eighth spreading guide shaft; 15—tension adjusting roller module; 16—bearing mounting seat; 17—ninth spreading guide shaft; 18—tenth spreading guide shaft; 19—eleventh spreading guide shaft; 20—twelfth guide shaft; 21—floating roller module; 22—frame type deviation correcting machine; 23—centrifugal fan I; 24—centrifugal fan II; 25—airflow duct I; 26—magnetically coupled cylinder; 27—airflow duct II; 28—linear slide rail; 29—thirteenth guide shaft; 30—fourteenth guide shaft; 31—tension detection roller II; 32—winding air shaft; 33—winding reel; 34—slider module II.

DETAILED DESCRIPTION OF THE EMBODIMENTS

The following clearly and completely describes the technical solutions in the embodiments of the present disclosure with reference to the accompanying drawings in the embodiments of the present disclosure. Apparently, the described embodiments are merely a part rather than all of the embodiments of the present disclosure. All other embodiments obtained by those of ordinary skill in the art based on the embodiments of the present disclosure without creative efforts shall fall within the protection scope of the present disclosure.

As shown in FIG. 1, an airflow disturbance type carbon fiber spread device is provided. The device includes an unwinding mechanism, a spreading mechanism, and a winding mechanism which are sequentially arranged along a feeding direction. The unwinding mechanism includes an unwinding module, and an unwinding tension control module is arranged at the discharge end of the unwinding assembly. The spreading mechanism includes an airflow disturbance spreading module, which is located at the discharge end of the unwinding tension control module. The winding mechanism includes a winding module, a winding tension stabilization module and a deviation correction module are provided between the winding module and the airflow disturbance spreading module, and the airflow disturbance spreading module and the deviation correction module are respectively located at the feed end and the discharge end of the winding tension stabilization module, and the winding module is located at the discharge end of the deviation correction module.

In particular, the unwinding module includes at least one unwinding assembly, the number of which can be adjusted according to actual production requirements. The unwinding assembly includes an unwinding air shaft 3, and a carbon fiber roll 2 is placed on the unwinding air shaft 3. In order to further ensure the tension stability in the unwinding process of the carbon fiber, the tail part of the unwinding air shaft 3 is connected to a magnetic powder brake to adjust the unwinding resistance of the unwinding air shaft 3, so as to control the unwinding tension of the carbon fiber. The unwinding air shaft 3 is mounted on the mounting seat, and the mounting seat is slidingly arranged on a sliding module I 1. The sliding module I 1 is mainly composed of an unwinding servo motor, a lead screw, a slide rail, and a sliding platform. The unwinding servo motor is connected to the lead screw by a coupling, and the lead screw is connected to the sliding platform by a lead screw support, and the sliding platform is mounted on the slide rail. The unwinding servo motor operates to drive the lead screw to rotate, and the lead screw rotates to drive the sliding platform to move along the slide rail. The sliding platform is provided with an unwinding shaft fixing seat for mounting the unwinding air shaft 3, and the unwinding serve motor can drive the unwinding air shaft 3 to move in the slide rail direction when operating.

A first guide shaft 4 is arranged at the discharge end of the unwinding air shaft 3, and the carbon fiber 6 released from the carbon fiber roll 2 is introduced into the unwinding tension control module through the first guide shaft 4. A position sensor 5 in fit with the carbon fiber 6 is arranged at the discharge end of the first guide shaft 4, and the position sensor 5 is connected to the sliding module I 1. Unwound carbon fiber passes through the position sensor 5 through the first guide shaft 4, and the position sensor 5 can be configured to monitor the position change of the carbon fiber in real time, and feed the signal back to the unwinding servo motor of the sliding module I. The unwinding servo motor rotates to drive the unwinding air shaft 3 to move along its own axial direction, so as to control the position movement of the unwinding air shaft 3 and ensure the unwinding position stability of the carbon fiber, thereby ensuring the stability of tension and running track of the carbon fiber, and eliminating the change of fiber tension and position caused by tow swing in the unwinding process of the carbon fiber tow.

The unwinding tension control module includes a tension detection roller I 9. The tension detection roller I 9 is connected to the magnetic powder brake, and is configured to detect the tension of the carbon fiber and feed the signal back to the magnetic powder brake connected to the unwinding air shaft 3. The magnetic powder brake is configured to adjust the unwinding resistance of the unwinding air shaft 3 in real time according to the detected tension signal. The tension detection roller I 9 is provided with a tension controller, which can be used to set the required tension value, i.e., the unwinding resistance of the unwinding air shaft 3. In actual use, the tension value can be set according to the technological requirements. The tension detection roller I 9 is configured to detect the tension in real time and feed the signal back to the magnetic powder brake. The magnetic powder brake provides a certain resistance value to the unwinding air shaft 3 according to the value detected by the tension detection roller I 9, thus achieving the purpose of stabilizing the tension of the carbon fiber.

One side of the tension detection roller I 9 is provided with a second guide shaft 7 and a third guide shaft 8, and the other side of the tension detection roller I 9 is provided with a fourth guide shaft 10 and a fifth guide shaft 11. The second guide shaft 7, the third guide shaft 8, the tension detection roller I 9, the fourth guide shaft 10 and the fifth guide shaft 11 are arranged in a M-shaped structure in a feeding direction and are all in fit with the carbon fiber 6. That this is means the carbon fiber passes through the second guide shaft 7, the third guide shaft 8, the tension detection roller I 9, the fourth guide shaft 10 and the fifth guide shaft 11 in sequence and finally enters the airflow disturbance spreading module.

The airflow disturbance spreading module includes two airflow disturbance spreading assemblies which are arranged side by side in a feeding direction, each airflow disturbance spreading assembly includes a centrifugal fan, the centrifugal fan communicates with the bottom of an airflow duct, and three spreading guide shafts are arranged side by side on the top of the airflow duct. In particular, the two airflow disturbance spreading assemblies include a centrifugal fan I 23 and a centrifugal fan II 24, respectively. Both centrifugal fan I 23 and centrifugal fan II 24 are variable-frequency fans, and the airflow rate can be controlled by adjusting the frequency of the variable-frequency fan. In actual use, the airflow rate can be gradually increased to the required value by adjusting the frequency of the centrifugal fan, thus avoiding the phenomenon of carbon fiber damage and carbon fiber twisting caused by the sudden change of air velocity. When the centrifugal fan is started and its power is gradually increased, on the one hand, the carbon fiber damage caused by the sudden change of airflow can be avoided. On the other hand, a stable airflow can be gradually formed at the upper end of an airflow pipeline to ensure the spreading uniformity and stability of the carbon fiber. Because the airflow is mainly used to disperse the carbon fiber in the spreading process, and the carbon fiber between two rollers is not in direct contact with the two rollers, the carbon fiber damage in the spreading process can be minimized.

In particular, the centrifugal fan I 23 communicates with the bottom of an airflow duct I 25, and a sixth spreading guide shaft 12, a seventh spreading guide shaft 13 and an eighth spreading guide shaft 14 are arranged side by side on the top of the airflow duct I 25. The centrifugal fan II 24 communicates with the bottom of an airflow duct II 27, and a ninth spreading guide shaft 17, a tenth spreading guide shaft 18 and an eleventh spreading guide shaft 19 are arranged side by side on the top of the airflow duct II 27. After the two centrifugal fans are started, a stable negative pressure can be formed at the upper end of the airflow duct as the power gradually increases to a set value, and the surrounding air forms a stable airflow under the action of pressure. Meanwhile, the carbon fiber tows are uniformly dispersed under the action of the six spreading guide shafts. The tension of the carbon fiber is small during the spreading, and the carbon fiber is dispersed mainly by the airflow, which can minimize the damage caused in the spreading process of carbon fiber.

Further, the seventh spreading guide shaft 13 is located at the upper port of the airflow duct I 25 and is connected to a slider module II 34. The slider module II 34 is mainly composed of a servo motor, a slide rail, a slider and a lead screw. The servo motor is connected to the lead screw by a coupling, the lead screw is connected to the slider through a lead screw support, and the slider is mounted on the slide rail. The seventh spreading guide shaft 13 is fixed to a mounting plate by screws, and the mounting plate is fixed to the slider by screws. The unwinding servo motor operates to drive the lead screw to rotate, and the lead screw rotates to drive the slider to move along the slide rail, thus driving the seventh spreading guide shaft 13 to move along its own axis, in which the motion amplitude and frequency are adjustable. The seventh spreading guide shaft 13 may exert a transverse force on the carbon fiber when moving along its own axis, thus promoting the spreading of the carbon fiber and improving the spreading efficiency. The tenth spreading guide shaft 18 is located at the upper port of the airflow duct II 27, and the position can be adjusted up and down. The upward and downward adjustment action of the tenth spreading guide shaft 18 is manual adjustment. A waist-type hole position is designed to correspond to the mounting position of the tenth spreading guide shaft 18 on the airflow duct II 27, and the position of the tenth spreading guide shaft 18 can be adjusted according to requirements. Such a structure is used to control the bending deflection of the carbon fiber and increase the spreading efficiency of the carbon fiber. The position parameters are generally unchanged once the commissioning is completed. When the carbon fiber is spread, the greater the bending deflection, the greater the fiber spread ratio, at the same time, the possibility of carbon fiber twisting in the spreading process is increased. In the actual operation process, the appropriate bending deflection of the carbon fiber can be set according to the actual spread ratio and efficiency requirements.

Further, a tension adjusting assembly is provided between the two airflow disturbance spreading assemblies. The tension adjusting assembly is used to adjust the tension of the carbon fiber by using a tension adjusting roller module 15, the tension adjusting roller module 15 is mainly composed of an adjusting roller, a bearing, a bearing mounting seat 16, a guide rail, and a magnetically coupled cylinder 26. The carbon fiber is arranged on the adjusting roller, the adjusting roller is mounted on the bearing mounting seat 16 by the bearing, the bearing mounting seat 16 is connected to the magnetically coupled cylinder 26 through the slider, and the magnetically coupled cylinder 26 can drive the adjusting roller to move up and down, thereby adjusting the tension of the carbon fiber in the spreading process. During the up-and-down movement of the adjusting roller, the carbon fiber may be in a relaxed state in an instant, and the action of the airflow can disperse the carbon fiber uniformly without damaging the carbon fiber.

Figure 2A:
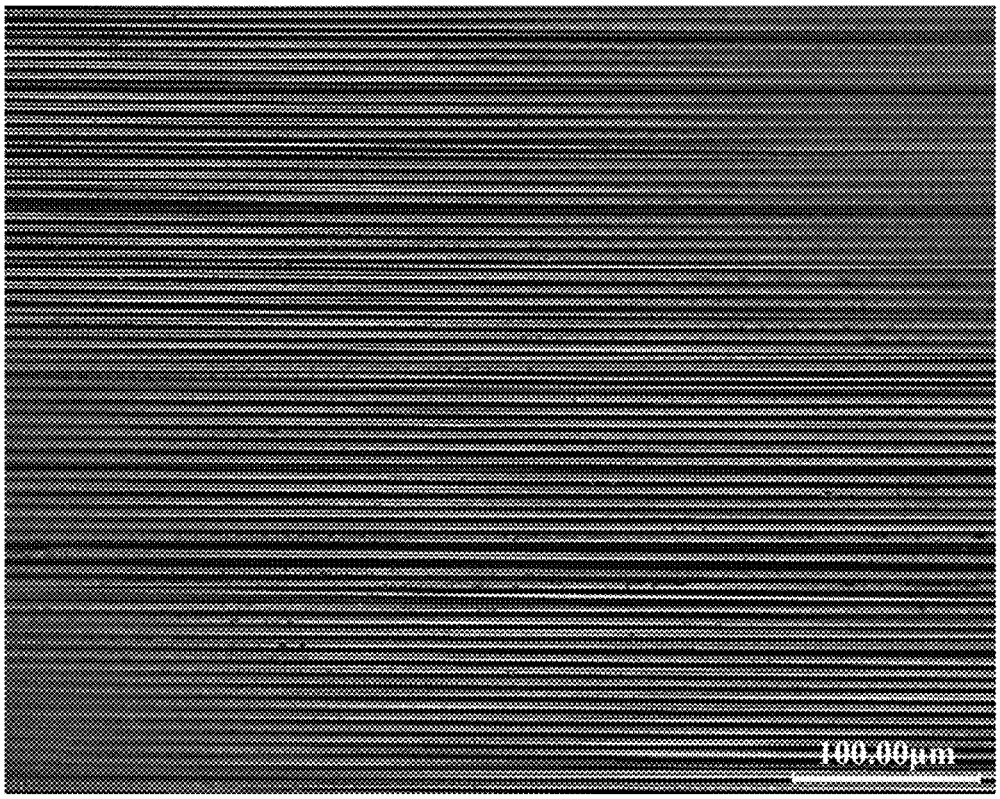
Figure 2B:
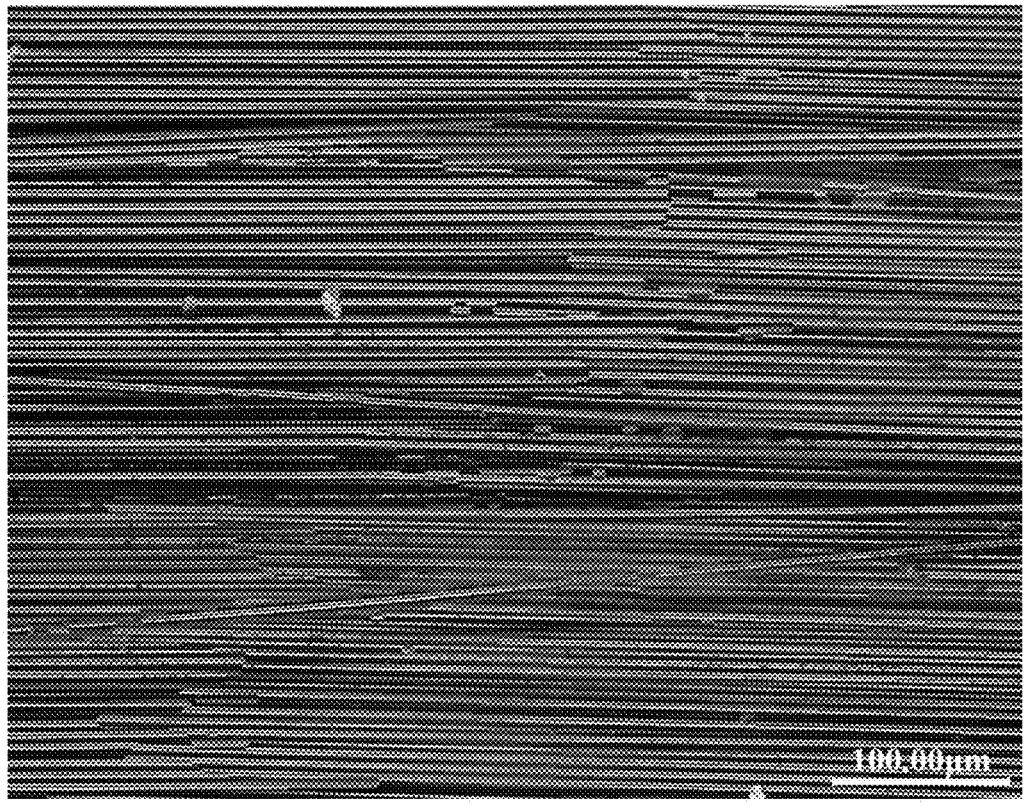

In order to characterize the damage to the carbon fiber by the spreading method, the surface micro-topography of the spread filament prepared according to the present disclosure and the surface micro-topography of the spread filament prepared by using a conventional mechanical method are compared and observed by using an ultra-depth of field microscope (the depth of field is magnified by 1000 times). As shown in FIGS. 2A-B, in which FIG. 2A is spread filaments prepared according to the present disclosure, showing that the fibers are arranged neatly, smooth in surface, free of obvious broken-filament phenomenon, which indicates that the ultra-thin, low-damage/non-damage spreading of untwisted yarns of the carbon fiber are achieved; and FIG. 2B is spread filaments prepared by using a conventional mechanical method, which has obvious broken-filament and damage, indicating that the fiber tow is obviously damaged in the process of mechanical tension spreading, which inevitably affects the mechanical properties of a prepreg tape prepared from the fiber.

In order to avoid the problem of carbon fiber entanglement caused by excessive winding tension during the winding of the spread carbon fiber, the tension of the spread carbon fiber needs to be adjusted by the winding tension stabilization module before winding. The winding tension stabilization module includes a floating roller module 21, and the floating roller module 21 is slidingly arranged on the linear slide rail 28. The floating roller module 21 is mainly composed of a floating roller, a bearing, a bearing mounting seat, a slider, and a slide rail. One end of the floating roller is mounted on the bearing mounting seat through the bearing, the bearing mounting seat is connected to the slider by screws, and the slider is mounted on the slide rail, that is, the floating roller can move along the slide rail. The floating roller can eliminate the carbon fiber tension change caused by the tension adjusting roller module 15, so that the carbon fiber is in a tensioned state before winding, and the weight of the floating roller can be selected according to the carbon fiber tension value. As the carbon fiber is in a real-time changing state during the spreading, it is not conducive to the subsequent stable winding, but the floating roller can enable the carbon fiber in the deviation correction and winding modules to be in a tensioned state, thus ensuring the stable winding. Further, both sides of the floating roller module 21 are respectively provided with a twelfth guide shaft 20 and a thirteenth guide shaft 29 in fit with the carbon fiber 6, and the carbon fiber 6 is introduced into the deviation correction module through the thirteenth guide shaft 29.

The deviation correction module includes a frame type deviation correcting machine 22. The frame type deviation correcting machine 22 is mainly composed of a laser sensor, a serve motor, a guide roller, and a guide roller mounting seat. The carbon fiber is arranged on the guide roller, the laser sensor is arranged on one side of the guide roller and corresponds to the carbon fiber, the guide roller is mounted on the guide roller mounting seat, and the bottom of the guide roller mounting seat is connected to an output shaft of the servo motor by a connecting rod. The laser sensor is configured to detect a carbon fiber position signal and feed the signal back to the servo motor. The servo motor operates to drive the guide shaft to rotate horizontally, thus correcting the running track of the spread carbon fiber, guaranteeing that the winding position of the carbon fiber is free of deviation, and improving the winding stability. A fourteenth guide shaft 30 is arranged at the discharge end of the frame type deviation correcting machine 22, the carbon fiber 6, after passing through the frame type deviation correcting machine 22, is introduced into the winding module via the fourteenth guide shaft 30.

The winding module includes a winding reel 33, the winding reel 33 is mounted on a winding air shaft 32, and the winding air shaft 32 is connected to a winding servo motor by a coupling. The winding servo motor is started to drive the winding air shaft 32 to rotate, and the winding air shaft 32 drives the winding reel 33 to rotate, thus achieving the winding process of the carbon fiber. A tension detection roller II 31 in fit with the carbon fiber 6 is arranged at the feed end of the winding reel 33, and is electrically connected to the winding servo motor. The tension detection roller II 31 is provided with a tension controller, which can be used to set the required tension value to control an output torque of the winding servo motor. The tension value can be set according to the actual demand to effectively avoid the problem of carbon fiber interlayer entanglement caused by excessive tension during winding. During the operation, the tension detection roller II 31 can be used to detect the carbon fiber tension change in real time, and feed the signal back to the winding servo motor. The output torque of the winding servo motor is adjusted after the winding serve motor receives the signal, so as to ensure that the winding tension of the carbon fiber is stable and cannot increase with the increase of the winding diameter, and the interlayer entanglement phenomenon after the carbon fiber is wound is avoided.

The carbon fiber roll 2 is placed on the unwinding air expansion shaft 3, the carbon fiber released after unwinding passes through the position sensor 5 and the tension detection roller I 9 in turn under the guidance of the first guide shaft 4, then passes through the airflow duct I 25 and the airflow duct II 27 in turn under the guidance of the spreading guide shafts. The track of the spread carbon fiber corrected through the frame type deviation correcting machine 22, then the winding tension of the spread carbon fiber is controlled under the action of the tension detection roller II 31, and the spread carbon fiber is finally wound on the winding reel 33.

The above description is only a preferred embodiment of the present disclosure and is not intended to limit the present disclosure. Any modification, equivalent replacement, improvement, etc. made within the spirit and principles of the present disclosure should be included within the scope of protection of the present disclosure.

What is claimed is:

1. A carbon fiber spread device, comprising an unwinding mechanism, a spreading mechanism, a winding mechanism which are sequentially arranged along a feeding direction, wherein the unwinding mechanism comprises an unwinding module; the unwinding module comprises at least one unwinding assembly, a carbon fiber roll (2) is placed on the unwinding assembly, and an unwinding tension control module is arranged at a discharge end of the unwinding assembly;

the spreading mechanism comprises an airflow disturbance spreading module, the airflow disturbance spreading module is located at a discharge end of the unwinding tension control module; the winding mechanism comprises a winding module; both a winding tension stabilization module and a deviation correction module are provided between the winding module and the airflow disturbance spreading module; and the airflow disturbance spreading module and the deviation correction module are respectively located at a feed end and a discharge end of the winding tension stabilization module; and the winding module is located at a discharge end of the deviation correction module;

the airflow disturbance spreading module comprises two airflow disturbance spreading assemblies, each airflow disturbance spreading assembly includes a centrifugal fan, the centrifugal fan communicates with a bottom of an airflow duct, and three spreading guide shafts are arranged side by side on a top of the airflow duct; a tension adjusting assembly is provided between the two airflow disturbance spreading assemblies; carbon fiber (6) is transmitted and guided by the three spreading guide shafts to achieve a uniform dispersion, and the tension adjusting assembly are configured to adjust tensile force of the carbon fiber (6); and one of the three spreading guide shafts (13) is located at an upper port of the airflow duct and is connected to a slider module (34).

2. The carbon fiber spread device according to claim 1, wherein the unwinding assembly comprises an unwinding air shaft (3), the carbon fiber roll (2) is placed on the unwinding air shaft (3), a tail part of the unwinding air shaft (3) is connected to a magnetic powder brake, the unwinding air shaft (3) is mounted on a mounting seat, and the mounting seat is arranged on a sliding module (1); a first guide shaft (4) is arranged at a discharge end of the unwinding air shaft (3), and carbon fiber (6) released from the carbon fiber roll (2) is introduced into the unwinding tension control module through the first guide shaft (4).

3. The carbon fiber spread device according to claim 2, wherein a position sensor (5) is configured to monitor position change of the carbon fiber (6) and is arranged at a discharge end of the first guide shaft (4), and the position sensor (5) is connected to the sliding module (1).

4. The carbon fiber spread device according to claim 3, wherein the unwinding tension control module comprises a first tension detection roller (9), and the first tension detection roller (9) is connected to the magnetic powder brake; one side of the first tension detection roller (9) is provided with a second guide shaft (7) and a third guide shaft (8), and the other side of the first tension detection roller (9) is provided with a fourth guide shaft (10) and a fifth guide shaft (11); the second guide shaft (7), the third guide shaft (8), the first tension detection roller (9), the fourth guide shaft (10) and the fifth guide shaft (11) are arranged in a M-shaped structure in a feeding direction, and the second guide shaft (7), the third guide shaft (8), the fourth guide shaft (10) and the fifth guide shaft (11) are configured to transmit and guide the carbon fiber (6), and the first tension detection roller (9) is configured to detect the tensile force of the carbon fiber (6).

5. The carbon fiber spread device according to claim 3, wherein the winding tension stabilization module comprises a floating roller module (21), and the floating roller module (21) is arranged on a linear slide rail (28); the floating roller module (21) has two sides which are respectively provided with a sixth guide shaft (20) and a seventh guide shaft (29), and the sixth guide shaft (20) and the seventh guide shaft (29) are configured to transmit and guide the carbon fiber (6), and the carbon fiber (6) is introduced into the deviation correction module through the seventh guide shaft (29).

6. The carbon fiber spread device according to claim 5, wherein the deviation correction module comprises a deviation correcting machine (22), a eighth guide shaft (30) is arranged at a discharge end of the deviation correcting machine (22), and the carbon fiber (6) passes through the deviation correcting machine (22) and is introduced into the winding module through the eighth guide shaft (30).

7. The carbon fiber spread device according to claim 6, wherein the winding module comprises a winding reel (33), the winding reel (33) is mounted on a winding air shaft (32), and the winding air shaft (32) is connected to a winding servo motor by a coupling.

8. The carbon fiber spread device according to claim 3, wherein the winding module comprises a winding reel (33), the winding reel (33) is mounted on a winding air shaft (32), and the winding air shaft (32) is connected to a winding servo motor by a coupling.

9. The carbon fiber spread device according to claim 8, wherein a second tension detection roller (31) is arranged at a feed end of the winding reel (33) and is configured to detect the tensile force of the carbon fiber (6), and the second tension detection roller (31) is electrically connected to the winding servo motor.

10. The carbon fiber spread device according to claim 2, wherein the unwinding tension control module comprises a first tension detection roller (9), and the first tension detection roller (9) is connected to the magnetic powder brake; one side of the first tension detection roller (9) is provided with a second guide shaft (7) and a third guide shaft (8), and the other side of the first tension detection roller (9) is provided with a fourth guide shaft (10) and a fifth guide shaft (11); the second guide shaft (7), the third guide shaft (8), the first tension detection roller (9), the fourth guide shaft (10) and the fifth guide shaft (11) are arranged in a M-shaped structure in a feeding direction, and the second guide shaft (7), the third guide shaft (8), the fourth guide shaft (10) and the fifth guide shaft (11) are configured to transmit and guide the carbon fiber (6), and the first tension detection roller (9) is configured to detect the tensile force of the carbon fiber (6).

11. The carbon fiber spread device according to claim 1, wherein the winding tension stabilization module comprises a floating roller module (21), and the floating roller module (21) is arranged on a linear slide rail (28); the floating roller module (21) has two sides which are respectively provided with a sixth guide shaft (20) and a seventh guide shaft (29), and the sixth guide shaft (20) and the seventh guide shaft (29) are configured to transmit and guide the carbon fiber (6), and the carbon fiber (6) is introduced into the deviation correction module through the seventh guide shaft (29).

12. The carbon fiber spread device according to claim 11, wherein the deviation correction module comprises a deviation correcting machine (22), a eighth guide shaft (30) is arranged at a discharge end of the deviation correcting machine (22), and the carbon fiber (6) passes through the deviation correcting machine (22) and is introduced into the winding module through the eighth guide shaft (30).

13. The carbon fiber spread device according to claim 12, wherein the winding module comprises a winding reel (33), the winding reel (33) is mounted on a winding air shaft (32), and the winding air shaft (32) is connected to a winding servo motor by a coupling.

14. The carbon fiber spread device according to claim 1, wherein the winding module comprises a winding reel (33), the winding reel (33) is mounted on a winding air shaft (32), and the winding air shaft (32) is connected to a winding servo motor by a coupling.

15. The carbon fiber spread device according to claim 14, wherein a second tension detection roller (31) is arranged at a feed end of the winding reel (33) and is configured to detect the tensile force of the carbon fiber (6), and the second tension detection roller (31) is electrically connected to the winding servo motor.

16. The carbon fiber spread device according to claim 2, wherein the winding tension stabilization module comprises a floating roller module (21), and the floating roller module (21) is arranged on a linear slide rail (28); the floating roller module (21) has two sides which are respectively provided with a sixth guide shaft (20) and a seventh guide shaft (29), and the sixth guide shaft (20) and the seventh guide shaft (29) are configured to transmit and guide the carbon fiber (6), and the carbon fiber (6) is introduced into the deviation correction module through the seventh guide shaft (29).

17. The carbon fiber spread device according to claim 16, wherein the deviation correction module comprises a deviation correcting machine (22), a eighth guide shaft (30) is arranged at a discharge end of the deviation correcting machine (22), and the carbon fiber (6) passes through the deviation correcting machine (22) and is introduced into the winding module through the eighth guide shaft (30).

18. The carbon fiber spread device according to claim 17, wherein the winding module comprises a winding reel (33), the winding reel (33) is mounted on a winding air shaft (32), and the winding air shaft (32) is connected to a winding servo motor by a coupling.

19. The carbon fiber spread device according to claim 2, wherein the winding module comprises a winding reel (33), the winding reel (33) is mounted on a winding air shaft (32), and the winding air shaft (32) is connected to a winding servo motor by a coupling.

20. The carbon fiber spread device according to claim 19, wherein a second tension detection roller (31) is arranged at a feed end of the winding reel (33) and is configured to detect the tensile force of the carbon fiber (6), and the second tension detection roller (31) is electrically connected to the winding servo motor.

* * * * *